United States Patent [19]

Crawford, Jr.

[11] 4,173,211

[45] Nov. 6, 1979

[54] PELLET GUN LOADING DEVICE

[76] Inventor: Tom H. Crawford, Jr., 408 S. Waverly St., Dallas, Tex. 75208

[21] Appl. No.: 865,441

[22] Filed: Dec. 29, 1977

[51] Int. Cl.[2] ..... F41F 9/06

[52] U.S. Cl. ..... 124/45; 42/87; 124/41 R; 221/266

[58] Field of Search ..... 124/41 R, 41 C, 45, 124/50, 51 R; 221/266; 222/363, 366; 42/87, 88

[56] References Cited

U.S. PATENT DOCUMENTS

| | | | |
|---|---|---|---|
| 1,148,297 | 7/1915 | Dickey | 124/51 R |
| 3,016,167 | 1/1962 | Richards, Jr. et al. | 221/266 X |
| 3,161,321 | 12/1964 | Mellion et al. | 221/266 |
| 3,242,609 | 3/1966 | Koistinen | 42/87 |
| 3,276,636 | 10/1966 | Johnson, Jr. | 221/266 |
| 3,896,967 | 7/1975 | Doolittle | 221/266 X |
| 4,122,933 | 10/1978 | Starzyk | 42/87 X |

FOREIGN PATENT DOCUMENTS

| | | | |
|---|---|---|---|
| 997772 | 7/1965 | United Kingdom | 222/363 |
| 1281517 | 7/1972 | United Kingdom | 221/266 |

*Primary Examiner*—Richard T. Stouffer

*Attorney, Agent, or Firm*—Richards, Harris & Medlock

[57] ABSTRACT

A dispensing device for loading pellets into the receiver of an air gun is provided and includes a housing having a pellet receiving aperture and a pellet dispensing aperture. The device includes an elongated hollow storage tube for retaining and storing a plurality of pellets in a predetermined orientation. One end of the storage tube is open for removably mating with the pellet receiving aperture in the housing to permit pellets retained and stored in the storage tube to enter the housing. Structure is provided within the housing for receiving one of the plurality of pellets from the storage tube through the pellet receiving aperture in the housing. This structure also transports within the housing a received pellet from the pellet receiving aperture to the pellet dispensing aperture for loading a single pellet in a predetermined orientation into the receiver of the air gun. During dispensing of the single pellet, the remaining ones of the plurality of pellets are retained in the storage tube and are prevented from entering the housing until a subsequent loading of the air gun.

4 Claims, 7 Drawing Figures

PELLET GUN LOADING DEVICE

FIELD OF THE INVENTION

This invention relates to dispensing devices, and more particularly to a dispensing device for loading pellets into an air gun.

THE PRIOR ART

Hunting enthusiasts have long utilized air guns, such as BB and pellet guns for hunting and target practice. A particular problem with the use of pellet guns, unlike BB guns, is the requirement that the pellet be properly inserted within the receiver of the air gun for accurate firing. Pellets must be oriented such that the flat portion exits the bore of the gun first to achieve proper velocity and flight path. Typical air pellet guns are one shot guns and require reloading after each shot. Therefore, the user of a pellet gun is faced with the task of manually inserting a new pellet into the gun after each firing. Because of the size of the pellet and the requirement that it be properly inserted, the use of a pellet gun becomes a very laborious and tedious process. This process requires a considerable amount of time between firings and therefore decreases the enjoyment and use of pellet air guns.

A need has thus arisen for a pellet gun loading device for easily and quickly dispensing pellets in the proper orientation into a pellet gun. Such a loading device needs to be easy to operate to minimize the complexities in loading a pellet gun as well as to minimize the time required to load such a gun. Moreover, a need has arisen for a pellet gun loading device that is economical to manufacture and that is simple in construction to avoid maintenance problems. Furthermore, a need has risen for a pellet gun loading device that is lightweight in construction so as not to increase the weight already carried by the pellet gun user.

SUMMARY OF THE INVENTION

In accordance with the present invention, a dispensing device for loading pellets into the receiver of an air gun is provided which permits easy and quick loading of pellets in the proper orientation into the air gun for firing. The dispensing device is simple in construction, lightweight and economical to manufacture.

In accordance with the present invention, a dispensing device for loading pellets into the receiver of an air gun includes a housing having a pellet receiving aperture and a pellet dispensing aperture. The device further includes an elongated hollow storage tube for retaining and storing a plurality of pellets in a predetermined orientation. One end of the storage tube is open removably mating with the pellet receiving aperture in the housing to permit pellets retained and stored in the storage tube to enter the housing. Structure is provided within the housing for receiving one of the plurality of pellets from the storage tube through the pellet receiving aperture in the housing. This structure also transports within the housing the received pellet to the pellet dispensing aperture for loading a single pellet in a predetermined orientation into the receiver of the air gun. During dispensing of the single pellet, the remaining ones of the plurality of pellets are retained in the storage tube and are prevented from entering the housing until a subsequent loading of the air gun.

In accordance with another aspect of the present invention, a dispensing device for loading pellets into the receiver of an air gun includes a circular housing having curvilinear wall portions. The wall portions include a pellet receiving aperture and a circumferentially disposed pellet dispensing aperture. An elongated hollow storage tube is provided having top, bottom and side walls for retaining and storing a plurality of pellets in a predetermined orientation. One end of the storage tube is open for removably mating to the housing for alignment with the pellet receiving aperture to permit pellets retained and stored in the storage tube to enter the housing. A pellet dispensing wheel having a peripheral surface and parallel side wall surfaces is disposed within the housing for circular movement therein. A portion of the peripheral surface of the pellet dispensing wheel is exposed through the housing curvilinear wall protions to permit an operator to rotate the pellet dispensing wheel within the housing. The peripheral surface of the pellet dispensing wheel includes a lpngitudinal slot perpendicularly disposed to the side wall surfaces of the pellet dispensing wheel. The slot opens outwardly of the pellet dispensing wheel. The longitudinal slot is dimensioned for receiving and retaining one of the plurality of pellets retained and stored within the storage tube. The housing further includes a shaft aligned with the pellet dispensing aperture for mating with the receiver of the air gun. The pellet dispensing wheel is rotatable within the housing between a first position in which the longitudinal slot is aligned with the pellet receiving aperture for receiving one of the plurality of pellets stored within the storage tube and a second position in which the longitudinal slot is aligned with the pellet dispensing aperture. In this second position, the single pellet is dispensed through the housing shaft for insertion in a predetermined orientation into the receiver of of the air gun. During dispensing of the single pellet, the pellet dispensing wheel simultaneously prevents the remaining ones of the plurality of pellets stored in the storage tube from entering the housing until a subsequent loading of the air gun.

DESCRIPTION OF THE DRAWINGS

For a more complete understanding of the present invention and for further objects and advantages thereof, reference is now made to the following detailed description taken in conjunction with the accompanying drawings, in which.

DESCRIPTION OF THE PREFERRED EMBODIMENT

Figure 1:
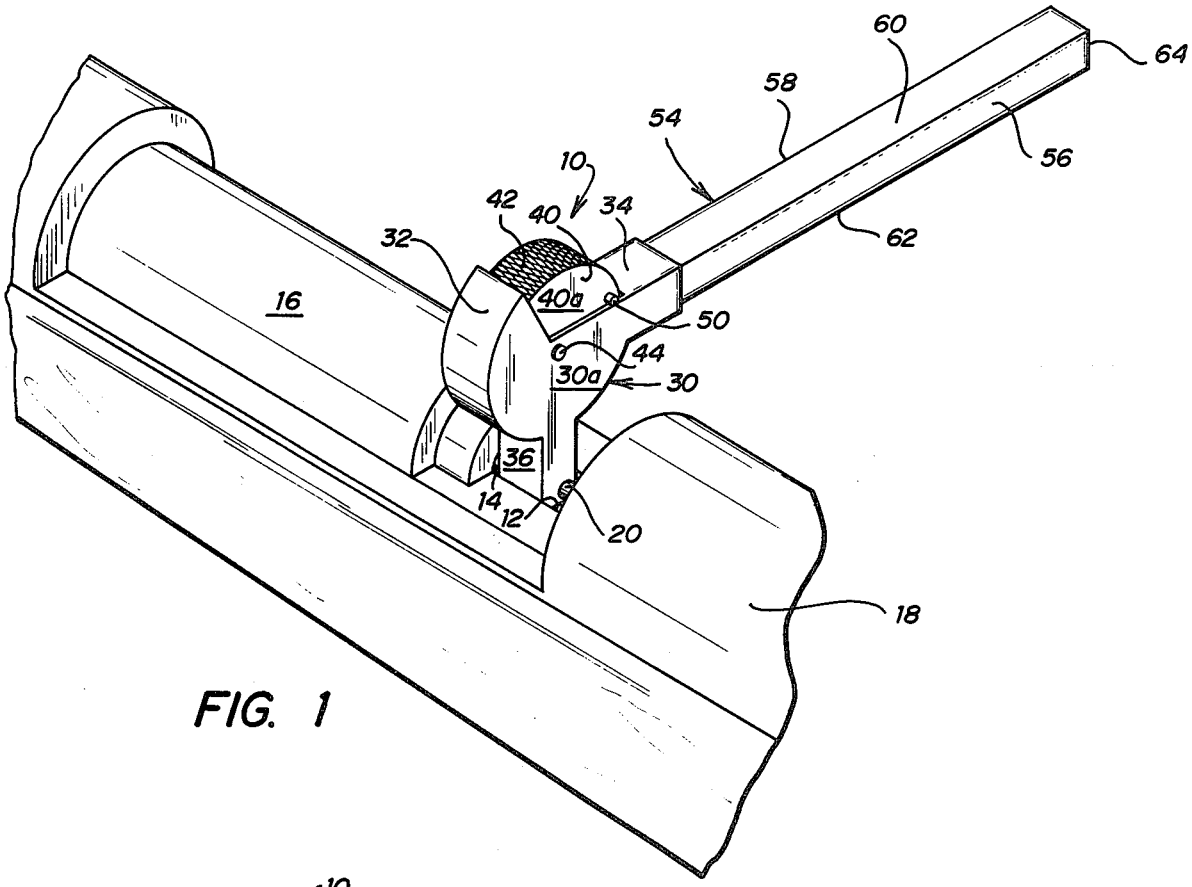
FIG. 1 is a perspective view of the present dispensing device positioned for dispensing pellets into the receiver of an air gun.

FIG. 1 illustrates the present pellet dispensing device, generally identified by the numeral 10. Pellet dispensing device 10 is positioned within receiver 12 at the rear of bore 14 of firing chamber 16 of an air gun 18. Air gun 18 may comprise a standard air gun, for example, a $CO_2$ air gun or a pump action air gun, such as those manufactured and sold by Marksman Products Division, Torrance, Calif., Coleman Company of Wichita, Kans. and Daisy Division of Rogers, Ark. under the Marksman, Crosman and Daisy names. Also shown in FIG. 1 is a portion of a bolt 20 of the air gun 18.

Figure 3:
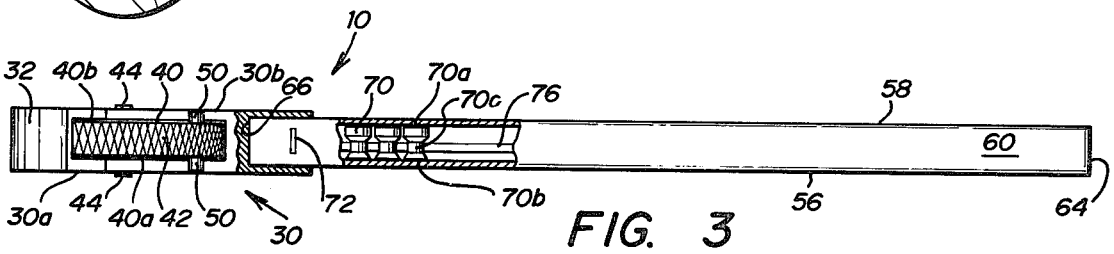
FIG. 3 is a top plan view of the present pellet dispensing device.
Figure 2:
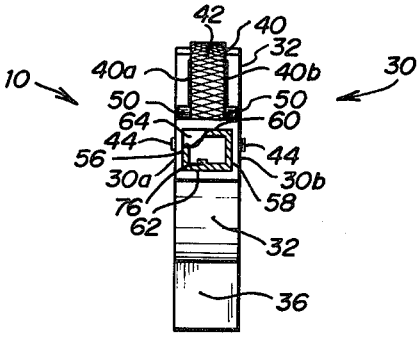
FIG. 2 is a rear elevational view of the present pellet dispensing device.

Referring simultaneously to FIGS. 1, 2 and 3, wherein like numerals are utilized for like and corresponding components, pellet dispensing device 10 includes a housing, generally identified by the numeral 30 having a curvilinear wall portion 32. Housing 30 includes a horizontal housing extension portion 34 and a vertical housing extension portion 36 for insertion into the receiver 12 of air gun 18. Housing 30 further includes a pellet dispensing wheel 40 having side walls 40*a* and 40*b* and a peripheral surface 42. Surface 42 is knurled to provide a gripping surface to permit rotation of pellet dispensing wheel 40 as will subsequently be described.

Pellet dispensing wheel 40 is mounted within housing 30 for rotational movement therein using a mounting pin 44 extending through side walls 30*a* and 30*b* of housing 30. Pellet dispensing wheel 40 further includes stop pins 50 for engaging housing 30 to restrict rotational movement of pellet dispensing wheel 40 as will subsequently be described.

Pellet dispensing device 10 further includes a storage tube, generally identified by the numeral 54. Storage tube 54 includes side walls 56 and 58, a top wall 60 and a bottom wall 62. Storage tube 54 also includes an end wall 64 and an open end 66 (FIG. 3). End 66 of storage tube 54 is mounted to horizontal housing extension 34 of housing 30 and is open such that pellets 70 stored within storage tube 54 can pass from storage tube 54 into housing 30. Storage tube 54 is removably mated to horizontal housing extension 34 through the use of slotted apertures 72 contained within top wall 60 and bottom wall 62 of storage tube 54 which mate with locking mechanisms 74 (FIG. 4).

FIG. 3 illustrates the orientation of pellets 70 retained and stored in storage tube 54. Pellets 70 may comprise, for example, 0.177-caliber pellets having a flat end portion 70*a* and a hollow end portion 70*b*. The interior portion of bottom wall 62 of storage tube 54 includes a vertically extending rib 76 positioned along the length of storage tube 54. Rib 76 is centrally disposed on bottom wall 62 and below central portion 70*c* of pellets 70. Rib 76 therefore pervents pellets 70 from rotating, once placed within storage tube 54. Pellets 70 are therefore maintained within storage tube 54 in a predetermined position for loading into receiver 12 of pellet gun 18. In the preferred embodiment storage tube 54 is dimensioned to store approximately fifty 0.177-caliber pellets.

Figure 4:
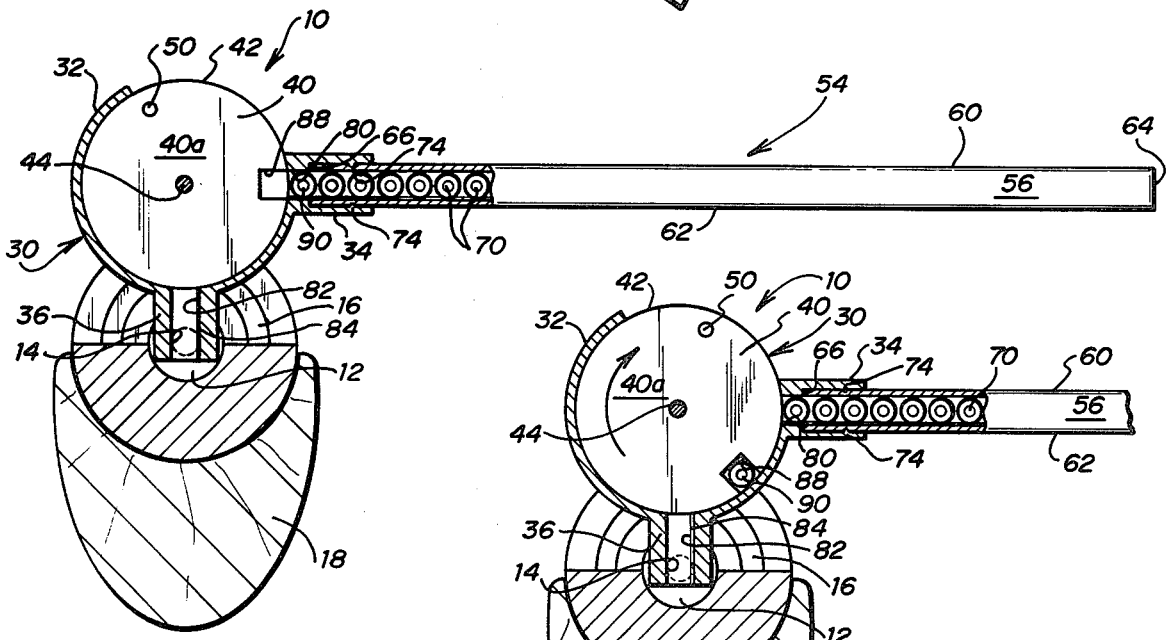
FIG. 4 is a side elevational view of the present pellet dispensing device, partially in section, shown in the pellet receiving position and positioned within the receiver of an air gun.

Referring to FIG. 4, housing side wall 30*a* of housing 30 has been removed for clarity of illustration to depict pellet dispensing wheel 40, the construction of horizontal housing extension 34 and vertical housing extension 36. Horizontal housing extension 34 includes an aperture 80. Aperture 80 permits pellets 70 stored within storage tube 54 to enter housing 30 through curvilinear wall portion 32 of housing 30. Similarly, an aperture 82 is located within vertical housing extension 36. Aperture 82 functions to permit pellets which have entered housing 30 to be dispensed from housing 30 into receiver 12 of air gun 18. Vertical housing extension 36 includes a rib 84 extending the length of aperture 82 and projecting into the area defined by aperture 82. Rib 84 is disposed to align with central portion 70*c* of pellets 70 and functions to maintain pellets 70 in the proper orientation as pellets 70 pass through aperture 82. FIG. 4 also illustrates the positioning of bore 14 of air gun 18. Dispensing device 10 and storage tube 54 in the preferred embodiment are constructed from polyvinyl cloride plastic suitable for injection type plastic molding.

Pellet dispensing wheel 40 includes a longitudinal slot 88 which is dimensioned to receive a single pellet 70 and extends throughout the entire width of pellet dispensing wheel 40 between side walls 40*a* and 40*b* thereof. Longitudinal slot 88 opens outwardly of pellet dispensing wheel 40 to receive a single pellet 70 from storage tube 54. Pellet dispensing wheel 40 functions to transport a received pellet 70 to aperture 82 in vertical housing extension 36 for dispensing into receiver 12 of air gun 18.

Figure 5:
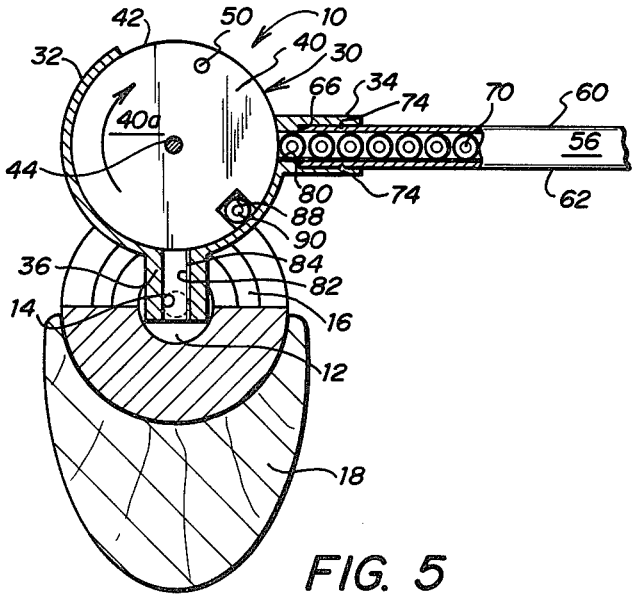
FIG. 5 is a side elevational view of the present pellet dispensing device, partially in section, shown in the pellet transporting position and positioned within the receiver of an air gun.
Figure 6:
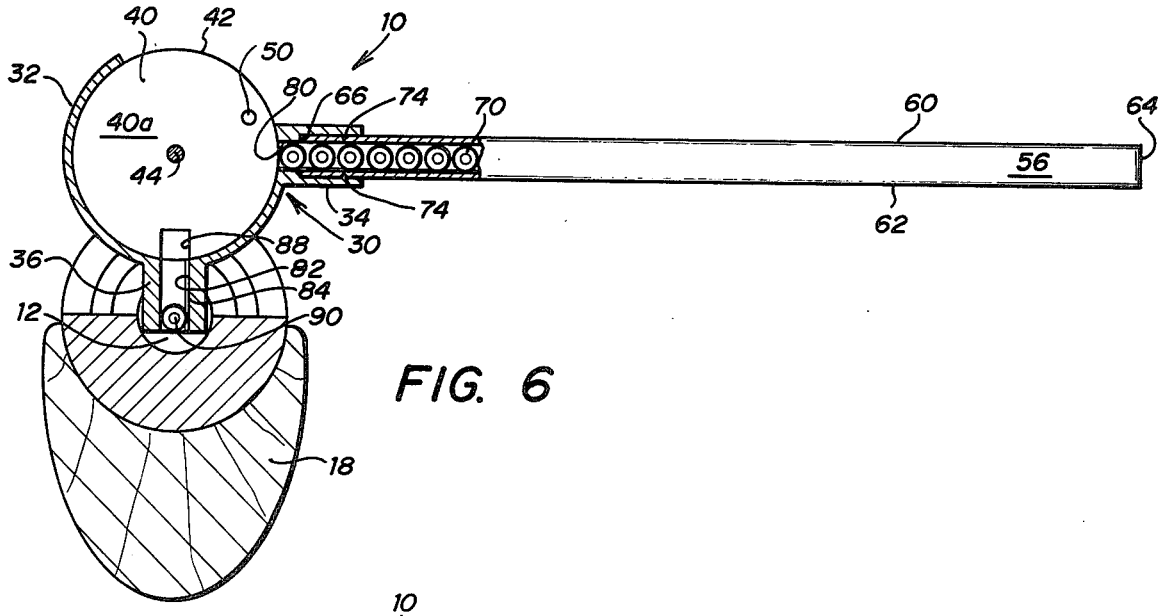
FIG. 6 is a side elevational view of the present pellet dispensing device, partially in section, shown in the pellet dispensing position and positioned within the receiver of an air gun.

Referring simultaneously to FIGS. 4, 5 and 6, wherein like numerals are utilized for like and corresponding components, the operation of the present pellet dispensing device 10 will now be described. Referring initially to FIG. 4, pellet dispensing wheel 40 is illustrated in a first position comprising the pellet receiving position. In this first position, longitudinal slot 88 is aligned with aperture 80 of horizontal housing extension 34. A single pellet 90 can therefore pass through aperture 80 for insertion into longitudinal slot 88 of pellet dispensing wheel 40. Due to the size of aperture 88, only one pellet can be received by pellet dispensing wheel 40.

The operator in using pellet dispensing device 10, after pellet 90 is received by slot 88, then rotates pellet dispensing wheel 40 in a clockwise direction by contacting surface 42 of pellet dispensing wheel 40 and imparting a rotational force to pellet dispensing wheel 40. As shown in FIG. 5, this rotational motion causes the received pellet 90 carried by longitudinal slot 88 within housing 30 to rotate from a position shown in FIG. 4 to a position between horizontal housing extension 34 and vertical housing extension 36. It can also be seen that due to the configuration of pellet dispensing wheel 40, the remaining pellets 70 stored within storage tube 54 are prevented from entering housing 30 because aperture 80 is closed by pellet dispensing wheel 40 as pellet dispensing wheel 40 rotates from the position illustrated in FIG. 4 to the position illustrated in FIG. 5.

Rotation of pellet dispensing wheel 40 is limited to a clockwise direction through the use of stop pins 50. Should a counterclockwise rotational motion be imparted to pellet dispensing wheel 40, stop pins 50 will abut against curvilinear wall portion 32 of housing 30 to thereby prevent further rotation of pellet dispensing wheel 40. This configuration prevents pellets which have entered housing 30 from being dispensed other than into receiver 12 of air gun 18.

FIG. 6 illustrates a second position comprising the pellet dispensing position of pellet dispensing wheel 40 in which longitudinal slot 88 has further rotated in a clockwise direction such that longitudinal slot 88 is aligned with aperture 82 in vertical housing extension 36. The transported pellet 90 under the force of gravity is then dispensed into receiver 12 when longitudinal slot 88 is in this second or dispensing position. FIG. 6 further illustrates the use of pellet dispensing wheel 40 to close aperture 80 and thereby prevent pellets 70 from entering housing 30 when a received pellet such as pellet 90 is transported from the receiving position as illustrated in FIG. 4 to the dispensing position as illustrated in FIG. 6. FIG. 6 also illustrates the use of stop pins 50 to prevent the further clockwise rotation of pellet dispensing wheel 40 past the pellet dispensing position in which longitudinal slot 88 aligns with aperture 36. This restraint is accomplished by stop pins 50 abutting housing side walls 30*a* and 30*b* adjacent horizontal housing extension 34.

In order to reload air gun 18 after pellet 90 has been chambered for firing and air gun 18 has been discharged, pellet dispensing wheel 40 is rotated in a counterclockwise direction to the position illustrated in FIG. 4. In this position pellet dispensing wheel 40 no longer blocks aperture 80 of horizontal housing extension 34 and the next pellet 70 stored in storage tube 54 will enter housing 30 through aperture 80 to be received by longitudinal slot 88.

After all pellets 70 stored in storage tube 54 have been dispensed, storage tube 54 can be removed from horizontal housing extension 34 for pellet reloading. Removal is accomplished by simultaneously depressing inwardly top and bottom walls 60 and 62 of storage tube 54 at a position adjacent locking mechanisms 74 to disengage locking mechanism 74 from slotted aperture 72 (FIGS. 3 and 4). Pellets 70 can then be loaded into storage tube 54 in the proper orientation wherein flat end portion 70*a* of pellets 70 lies adjacent side wall 58 of storage tube 54 and hollow end portion 70*b* of pellets 70 lies adjacent side wall 56 of storage tube 54. Storage tube 54 can then be reinserted into horizontal housing extension 34 such that locking mechanisms 74 again engage slotted apertures 72 for subsequent use in dispensing pellets 70 into receiver 12 of air gun 18.

Figure 7:
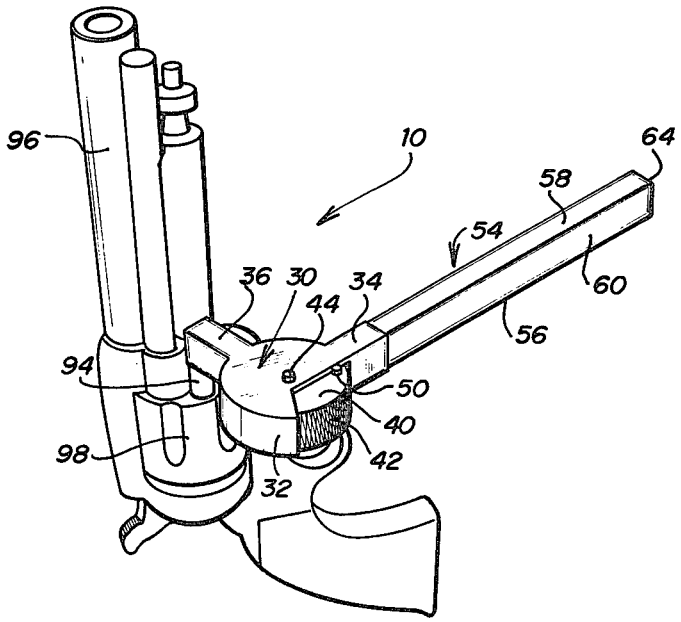
FIG. 7 is a perspective view of the present pellet dispensing device including the use of an adapter for loading a pellet pistol.

FIG. 7 illustrates the use of a guideway 94 for use with pellet dispensing device 10 for loading of an air pistol 96. Guideway 94 is inserted into aperture 82 of vertical housing extension 36 and provides a channel for dispensing pellets 70 from aperture 36 to a cylinder 98 of air pistol 96. The operation of pellet dispensing device 10 for use with air pistol 96 is similar to the operation as previously described in connection with air gun 18.

It therefore can be seen that the dispensing device of the present invention provides a dispenser for loading pellets into the receiver of an air gun that is easy to operate and which minimizes the laborious and tedious task of loading individual pellets into the receiver of an air gun. The dispensing device is simple in construction to minimize maintenance problems and the cost of construction. The dispensing device further can be adapted for use with air pistols.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. A dispensing device for loading pellets into the receiver of an air gun comprising:

a circular housing having curvilinear wall portions, said wall portions including a pellet receiving aperture and a circumferentially disposed pellet dispensing aperture for mating and communicating with the receiver of the air gun;

an elongated hollow storage tube having top, bottom and side walls for retaining and storing a plurality of pellets in a predetermined orientation, one end thereof being open for removably mating to said housing adjacent said pellet receiving aperture to permit pellets retained and stored in said storage tube to enter said housing;

said bottom wall of said storage tube having an interior surface including a centrally disposed rib for maintaining said plurality of pellets in said predetermined orientation;

a pellet dispensing wheel having a peripheral surface and parallel side wall surfaces rotatably disposed within said housing for circular movement therein, a portion of said peripheral surface of said pellet dispensing wheel being exposed through said housing curvilinear wall portions to permit an operator to rotate said pellet dispensing wheel within said housing;

said peripheral surface of said pellet dispensing wheel including a longitudinal slot perpendicularly disposed to said side wall surfaces of said pellet dispensing wheel, said longitudinal slot opening outwardly of said pellet dispensing wheel and being dimensioned for retaining one of said plurality of pellets retained and stored in said storage tube;

said housing further including a shaft aligned with said pellet dispensing aperture for mating with the receiver of the air gun; and said pellet dispensing wheel being rotatable within said housing between a first position in which said longitudinal slot is aligned with said pellet receiving aperture for receiving one of said plurality of pellets retained and stored in said storage tube and a second position in which said longitudinal slot is aligned with said pellet dispensing aperture for dispensing said received pellet through said housing shaft for insertion in a predetermined orientation into the receiver of the air gun while simultaneously preventing the remaining ones of said plurality of pellets retained and stored in said storage tube from entering said housing until a subsequent loading of the air gun.

2. The dispensing device of claim 1 wherein said housing further includes lock means and said top and bottom walls of said storage tube include slotted apertures for receiving said lock means for movably mating said storage tube to said housing.

3. The dispensing device of claim 1 wherein said pellet dispensing wheel further includes stop means for restraining rotation of said pellet dispensing wheel within said housing other than between said first and second positions.

4. The dispensing device of claim 1 wherein said housing further includes means for guiding said received pellet from said pellet dispensing aperture in said housing to the receiver of the air gun.

* * * * *

UNITED STATES PATENT AND TRADEMARK OFFICE

CERTIFICATE OF CORRECTION

PATENT NO. : 4,173,211

DATED : November 6, 1979

INVENTOR(S) : Tom H. Crawford, Jr.

It is certified that error appears in the above-identified patent and that said Letters Patent are hereby corrected as shown below:

Column 2, line 17, change "protions" to --portions--.
Column 2, line 19, change "lpngitudinal" to --longitudinal--.
Column 3, line 59, change "pervents" to --prevents--.
Column 6, line 55, change "movably" to --removably--.

Signed and Sealed this

*Twenty-ninth* Day of *April 1980*

[SEAL]

*Attest:*

SIDNEY A. DIAMOND

*Attesting Officer*

*Commissioner of Patents and Trademarks*